US008925233B2

(12) United States Patent
Thordsen

(10) Patent No.: US 8,925,233 B2
(45) Date of Patent: Jan. 6, 2015

(54) AMBIDEXTROUS TOOL-ACTUATED COVERED MAGAZINE RELEASE

(71) Applicant: Alan T. Thordsen, San Mateo, CA (US)

(72) Inventor: Alan T. Thordsen, San Mateo, CA (US)

( * ) Notice: Subject to any disclaimer, the term of this patent is extended or adjusted under 35 U.S.C. 154(b) by 77 days.

(21) Appl. No.: 13/772,254

(22) Filed: Feb. 20, 2013

(65) Prior Publication Data

US 2013/0227869 A1 Sep. 5, 2013

Related U.S. Application Data

(60) Provisional application No. 61/601,390, filed on Feb. 21, 2012.

(51) Int. Cl.
*F41A 17/38* (2006.01)
*F41C 27/00* (2006.01)

(52) U.S. Cl.
CPC ..... *F41C 27/00* (2013.01); *F41A 17/38* (2013.01)
USPC ..... 42/70.02; 42/90; 42/50

(58) Field of Classification Search
CPC ..... F41A 17/38; F41A 9/63; F41A 9/61; F41A 9/65; F41A 17/00; F41A 17/34; F41A 3/82; F41C 27/00
USPC ..... 42/6, 49.01, 70.02, 70.01, 70.11, 90, 42/106, 108, 50, 49.1, 49.02; 89/197, 89/33.1, 128
See application file for complete search history.

(56) References Cited

U.S. PATENT DOCUMENTS

| | | | | |
|---|---|---|---|---|
| 6,173,519 | B1 * | 1/2001 | Garrett | 42/90 |
| 8,307,578 | B1 * | 11/2012 | Azhocar | 42/108 |
| 8,635,799 | B2 * | 1/2014 | Azhocar | 42/108 |
| 8,776,426 | B1 * | 7/2014 | Symonds | 42/90 |
| 2013/0333264 | A1 * | 12/2013 | Azhocar | 42/90 |
| 2014/0165439 | A1 * | 6/2014 | Fernandez et al. | 42/6 |

OTHER PUBLICATIONS

"Introducing the B-16 Bullet Button! That's Right, SIXTEEN!—Calguns.net." Calgunsnet RSS. N.p., n.d. Web. Aug. 25, 2014. <http://www.calguns.net/calgunforum/showthread.php?t=135888>.*

* cited by examiner

*Primary Examiner* — Michael Carone
*Assistant Examiner* — Jonathan C Weber
(74) *Attorney, Agent, or Firm* — Kang S. Lim

(57) ABSTRACT

The present invention provides an AR variant rifle with a left-sided magazine-release assembly which includes a mag-release catch, a left-sided tool-actuated mag-release actuator, a left-sided actuator cover and a mag-release spring. The actuator is operatively coupled to a mag-release catch and can be actuated by a mag-release tool thereby causing a detachable magazine to be released from a magazine well of the rifle. The actuator cover is configured to be mounted on a left side of the rifle and provides support and substantially shields the mag-release actuator thereby permitting the mag-release actuator to be actuated with any mag-release tool from the left side the lower receiver while preventing the mag-release actuator from being actuated without use of any mag-release tool.

9 Claims, 13 Drawing Sheets

AMBIDEXTROUS TOOL-ACTUATED COVERED MAGAZINE RELEASE

CROSS REFERENCE TO RELATED APPLICATIONS

This non-provisional application claims the benefit of provisional application No. 61/601,390 filed on Feb. 21, 2012, entitled "Systems and Methods for Efficient Release of Firearm Magazines", which application is incorporated herein in its entirety by this reference.

BACKGROUND

The present invention relates to systems and methods for efficiently releasing detachable magazines from firearms incorporating tool-actuated magazine-release mechanism with minimal deviation from normal firearm operating procedures.

Different types of firearms and firearm accessories have increased steadily over time in both functionality and flexibility, and today there is a wide variety of firearm modifications and/or accessories available. Innovation in the firearms industry is also driven by legislative trends, as firearm owners are required to respond by limiting the functionality of their firearms and/or accessories.

In recent times, Federal and/or State laws have limited features of semi-automatic firearms and/or also the capacity of firearm magazines. For example, in some jurisdictions, the use of detachable magazines with semi-automatic rifles is strictly regulated. To comply, the magazine-release mechanism of these semi-automatic rifles has to be modified to work only with a tool such as the bullet tip of a rifle cartridge. One common solution for semi-automatic AR-15 variants is to install a "bullet-button" magazine release assembly located on the right side of the firearm receiver to prevent the user from being able to remove a detachable magazine from the rifle without a tool.

Unfortunately, these AR-15 variants were designed for right-handed users, with the magazine release button located on the right side of the lower receiver so as to be manipulated by the index finger (the trigger finger) of the "firing" (right) hand according to the AR variants' normal operating procedure. As a result, releasing a magazine from an AR-15 variant incorporating a tool-actuated magazine-release mechanism with the left hand holding a magazine release tool is awkward at best. Alternatively, operating a magazine release tool with the right hand requires removing the firing (right) hand from the firearm's grip which results in substantially slower reloading speed.

It is therefore apparent that an urgent need exists for improved tool-actuated magazine-release mechanisms located on the left side of the rifle receiver for efficiently releasing magazines from AR-15 variant rifles using the support (left) hand of the user. These improved magazine-release mechanisms should enable users to quickly and effectively release magazines from rifles without removing the right (firing) hand from the grip of the rifle.

SUMMARY

To achieve the foregoing and in accordance with the present invention, systems and methods for efficiently releasing detachable magazines from firearms incorporating tool-actuated magazine-release mechanism is provided. In particular, a left-sided tool-actuated magazine-release assembly for mounting to AR-15 variants enables users to efficiently detach magazines from the rifle using a magazine-release tool held by the left hand while maintaining a normal firing grip with the right hand.

In one embodiment, an AR-15 variant rifle includes an ambidextrous tool-actuated magazine-release assembly comprising of a mag-release catch, a left-sided tool-actuated mag-release actuator, a left-sided actuator cover, a mag-release spring, a right-sided tool-actuated mag-release button and a right-sided mag-release button shield.

The left-sided actuator is operatively coupled to a mag-release catch and can be actuated by a mag-release tool thereby causing a detachable magazine to be released from a magazine well of the rifle. The actuator cover is configured to be mounted on a left side of the rifle and provides support and substantially shields the mag-release actuator thereby permitting the mag-release actuator to be actuated with any mag-release tool from the left side the lower receiver while preventing the mag-release actuator from being actuated without use of any mag-release tool.

The mag-release spring is operatively coupled to a threaded shaft of the mag-release catch. The right-sided mag-release button is operatively coupled to the mag-release catch and can be actuated by any mag-release tool from a right side of the rifle thereby causing the magazine to be released from the rifle. The mag-release button shield is configured to be installed on the right side of the rifle, and substantially shield the mag-release button thereby preventing the mag-release button from being actuated without use of any mag-release tool.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Figure 1:
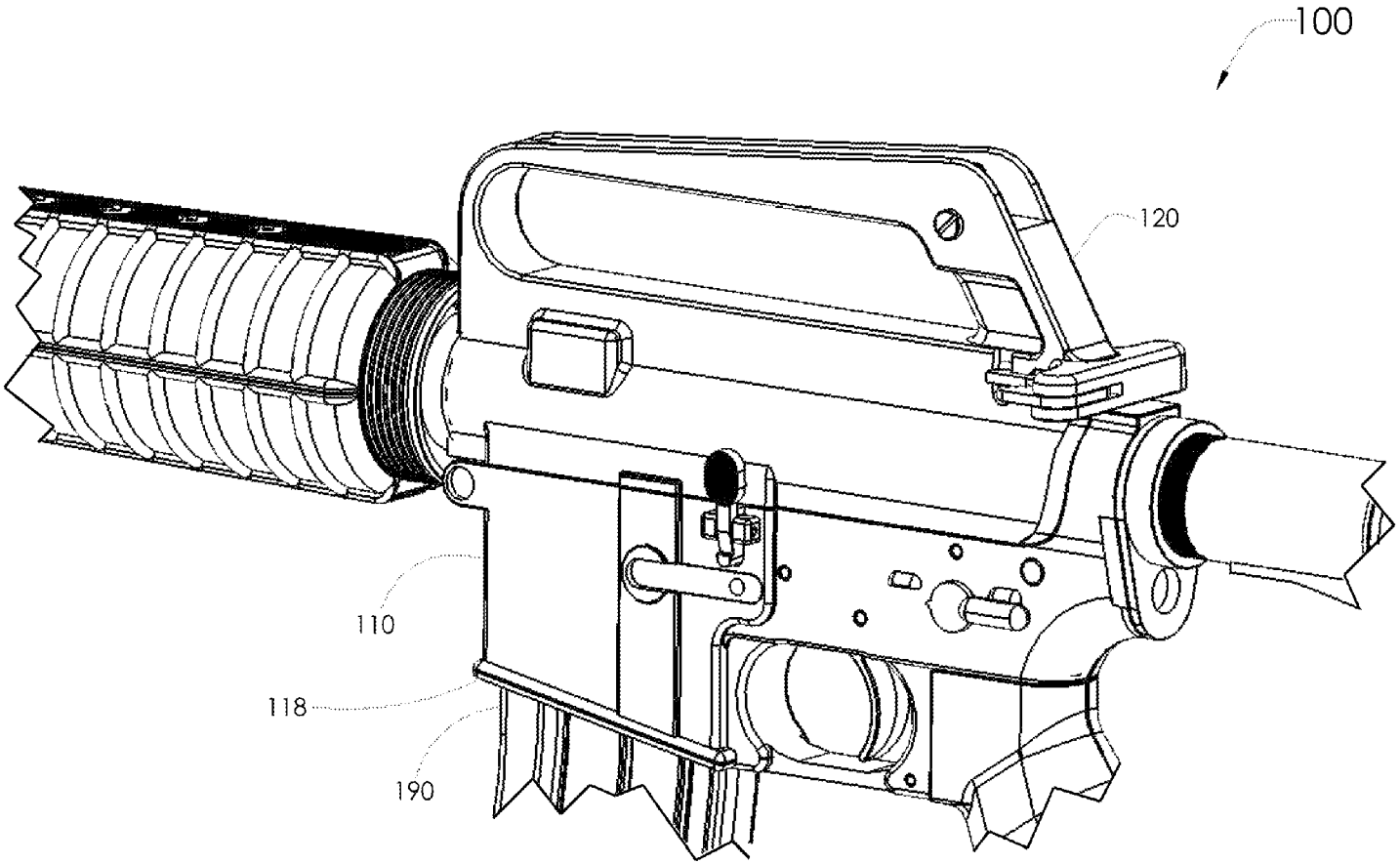
FIG. 1 is a perspective view of an unmodified AR-15 variant rifle.
Figure 2:
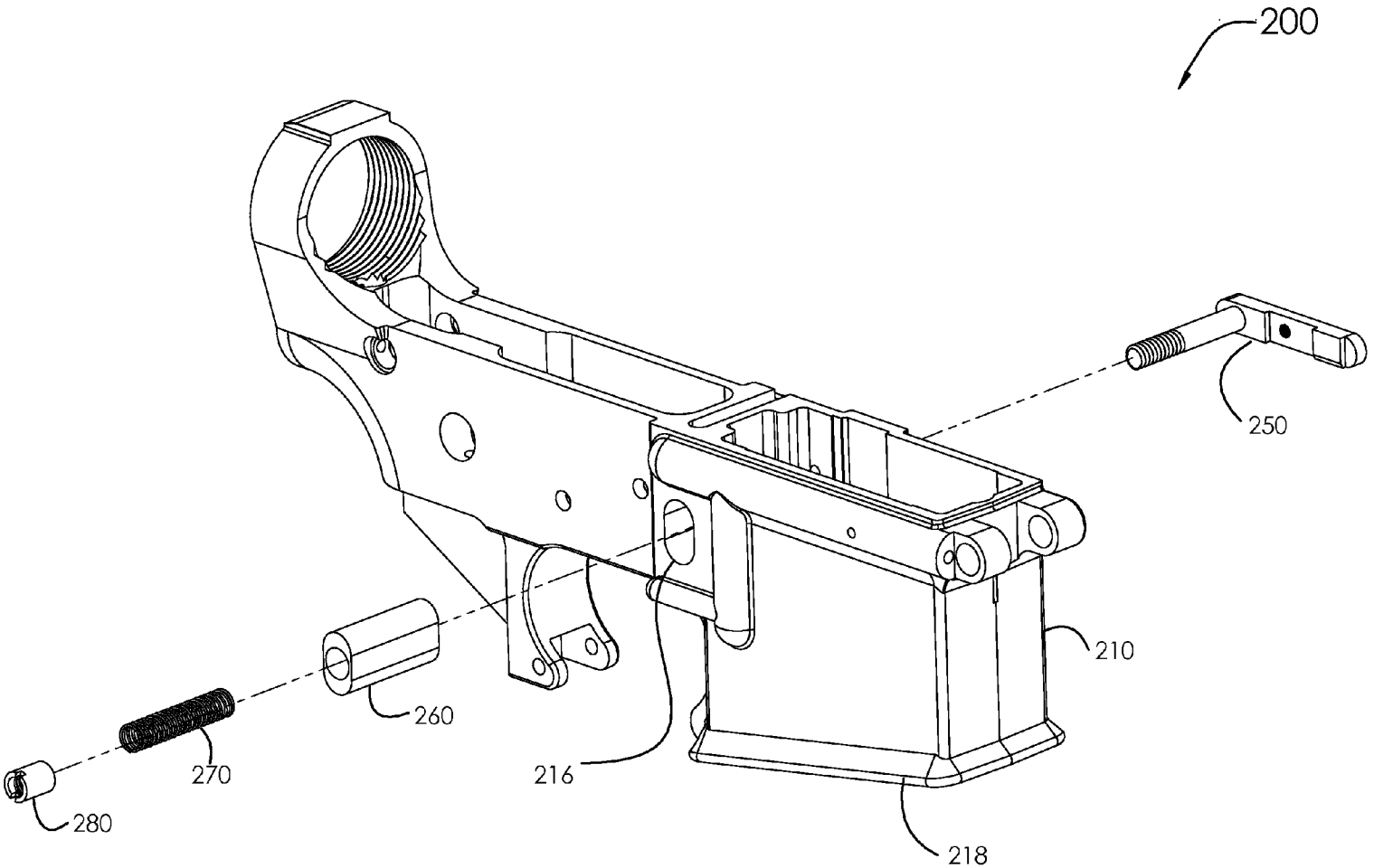
FIG. 2 is an exploded view of a lower receiver of an AR-15 variant rifle with a right-sided tool-actuated magazine release assembly.

The present invention relates to systems and methods for efficiently releasing detachable magazines from firearms using a tool. FIG. 1 is a perspective view of an unmodified AR-15 variant rifle 100 including an upper receiver 120 operatively coupled to an assembled lower receiver 110 with a detachable magazine ("mag") 190 inserted into a magazine well 118. FIG. 2 shows an exploded view of a stripped lower receiver 210 of an AR-15 variant rifle together with a right-sided tool-actuated magazine release assembly including a mag-release catch 250, a mag-release button shield 260, a mag-release spring 270 and a tool-actuated mag-release button 280.

Figure 3:
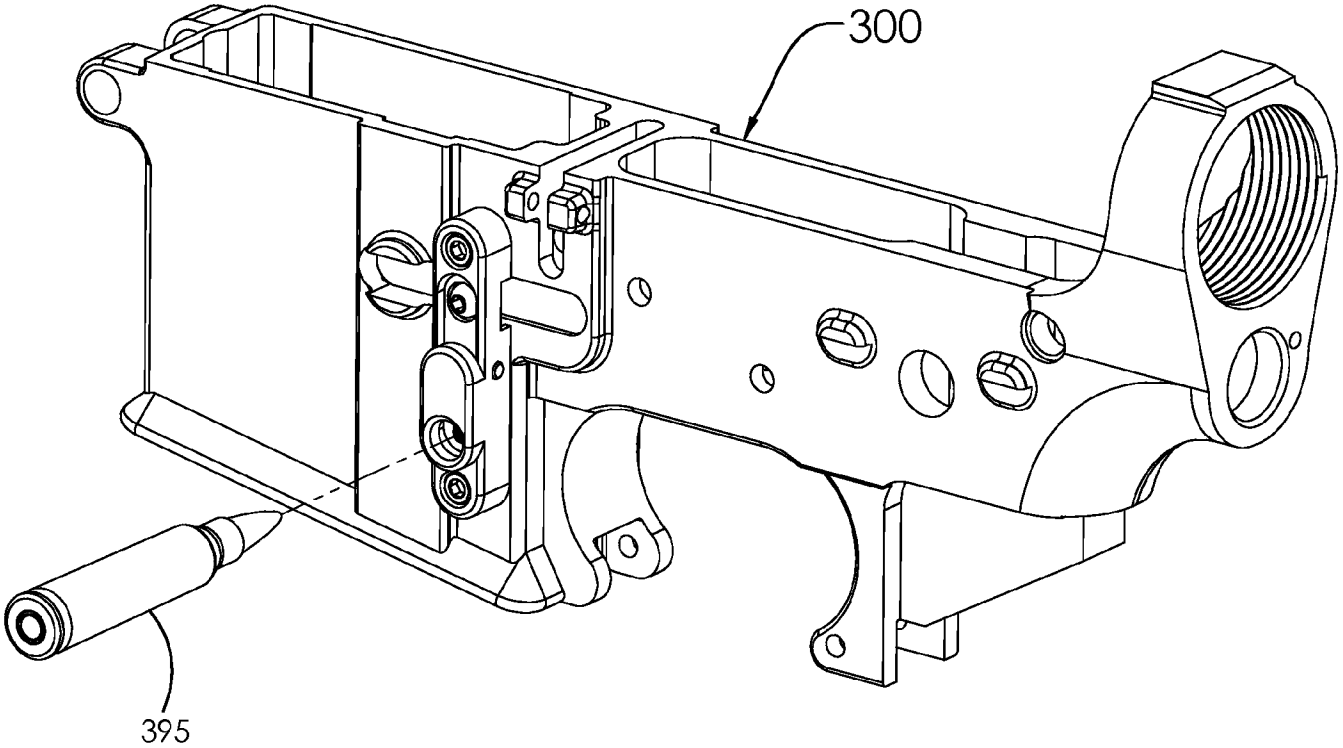
FIG. 3 is a perspective view of an AR-15 variant lower receiver including a left-sided tool-actuated magazine release assembly in accordance with one embodiment of the present invention.
Figure 4:
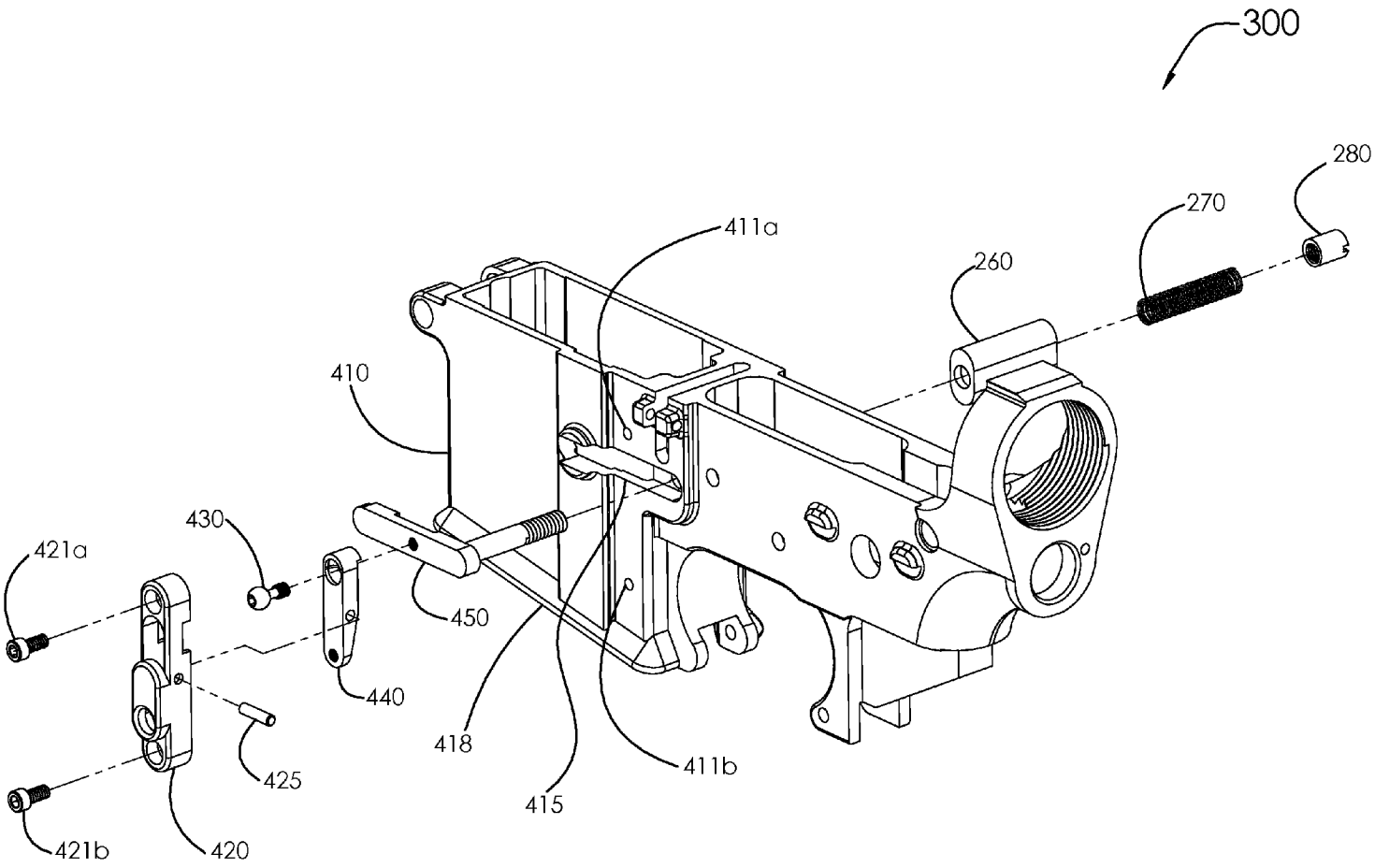
FIGS. 4 and 5 are exploded views of a stripped lower receiver together with the components of the right-sided and left-sided magazine-release assemblies of FIGS. 2 and 3, respectively.
Figure 5:
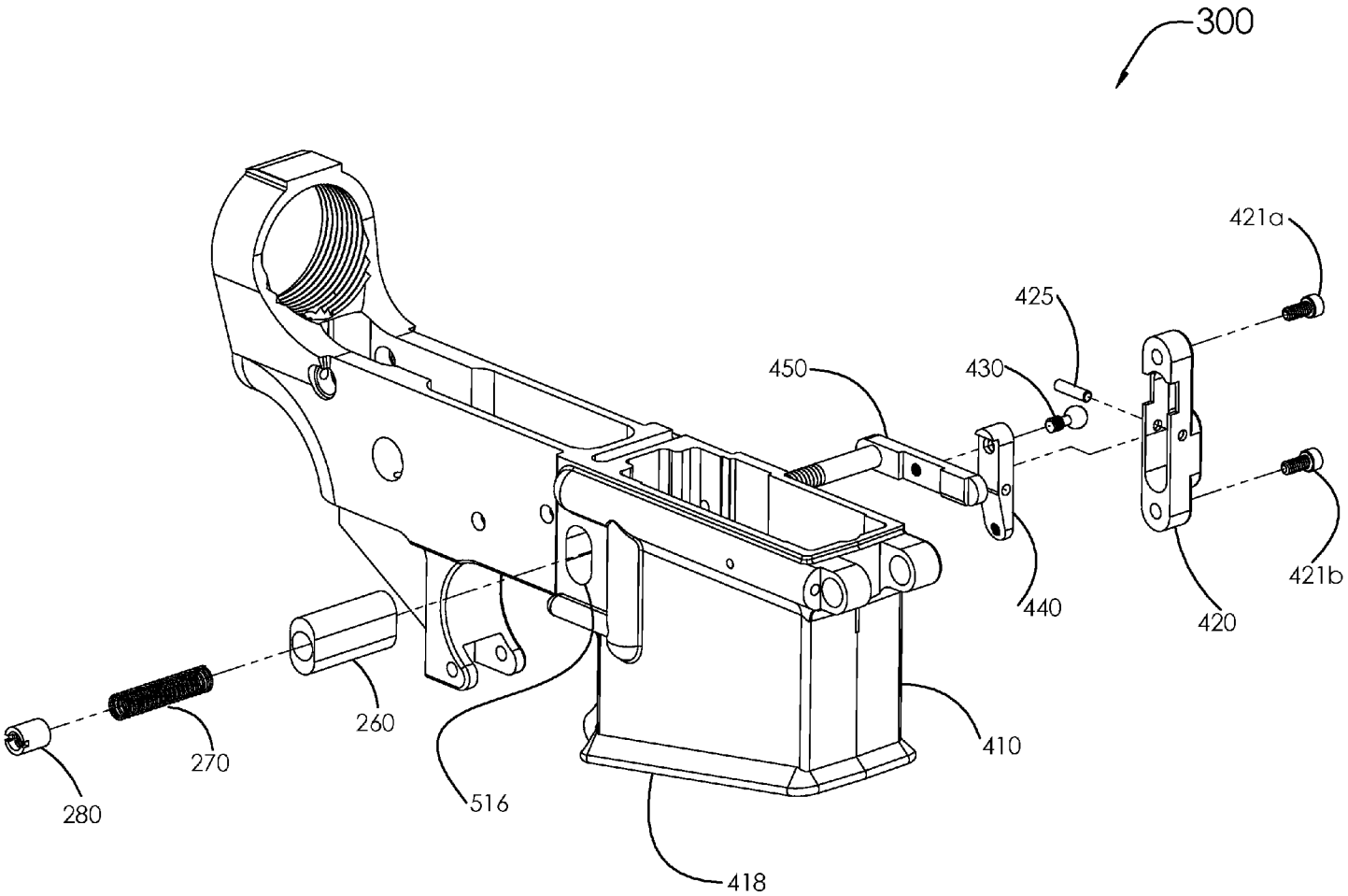

To facilitate discussion, FIG. 3 is a perspective view of a partially-assembled and modified AR-15 variant lower receiver 300 including a left-sided tool-actuated mag-release assembly configured to be actuated by an exemplary mag-release tool 395, e.g., a bullet, in accordance with one embodiment of the present invention. In addition, FIGS. 4, 5 are exploded views of a stripped lower receiver 410 of FIG. 3 together with exemplary right-handed mag-release assembly components 260, 270, 280 and exemplary left-handed mag-release assembly components 420, 430, 440, 450.

In this embodiment, the right-handed tool-actuated mag-release assembly of lower receiver 300 includes a mag-release button shield 260, a mag-release spring 270 and a tool-actuated mag-release button 280, while right-sided tool-actuated mag-release assembly of receiver 300 includes mounting screws 421*a*, 421*b*, a mag-release actuator cover 420, a pivot pin 425, a mag-release coupler 430, a mag-release actuator 440 and a mag-release catch 450. Note that mag-release catch 450 is a modified version of mag-release catch 250 of FIG. 2. Note also that pivot pin 425 can either be a roll pin or a solid rod.

Figure 6A:
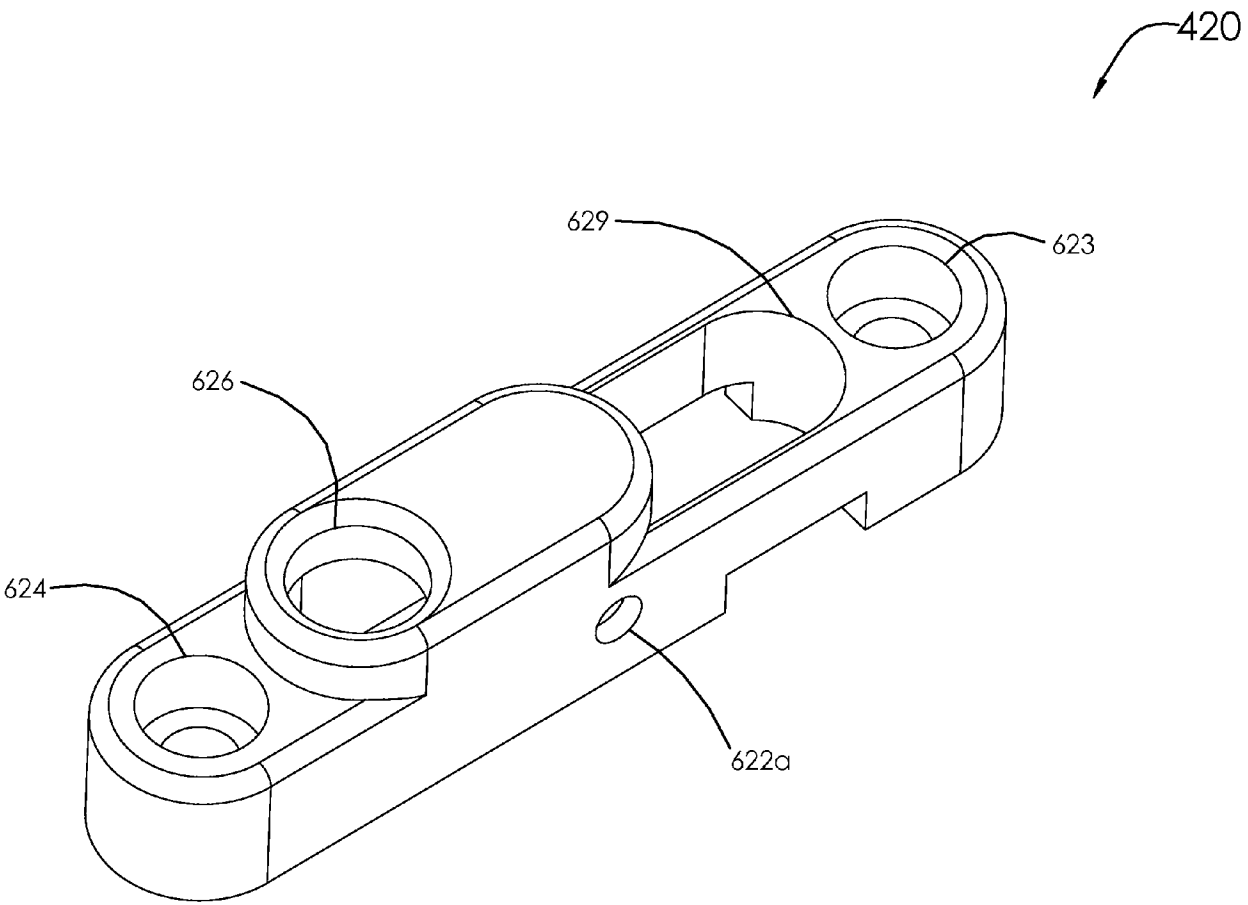
FIGS. 6A and 6B are top and bottom perspective views of a mag-release actuator cover of the left-sided magazine-release assembly of FIG. 3.
Figure 6B:
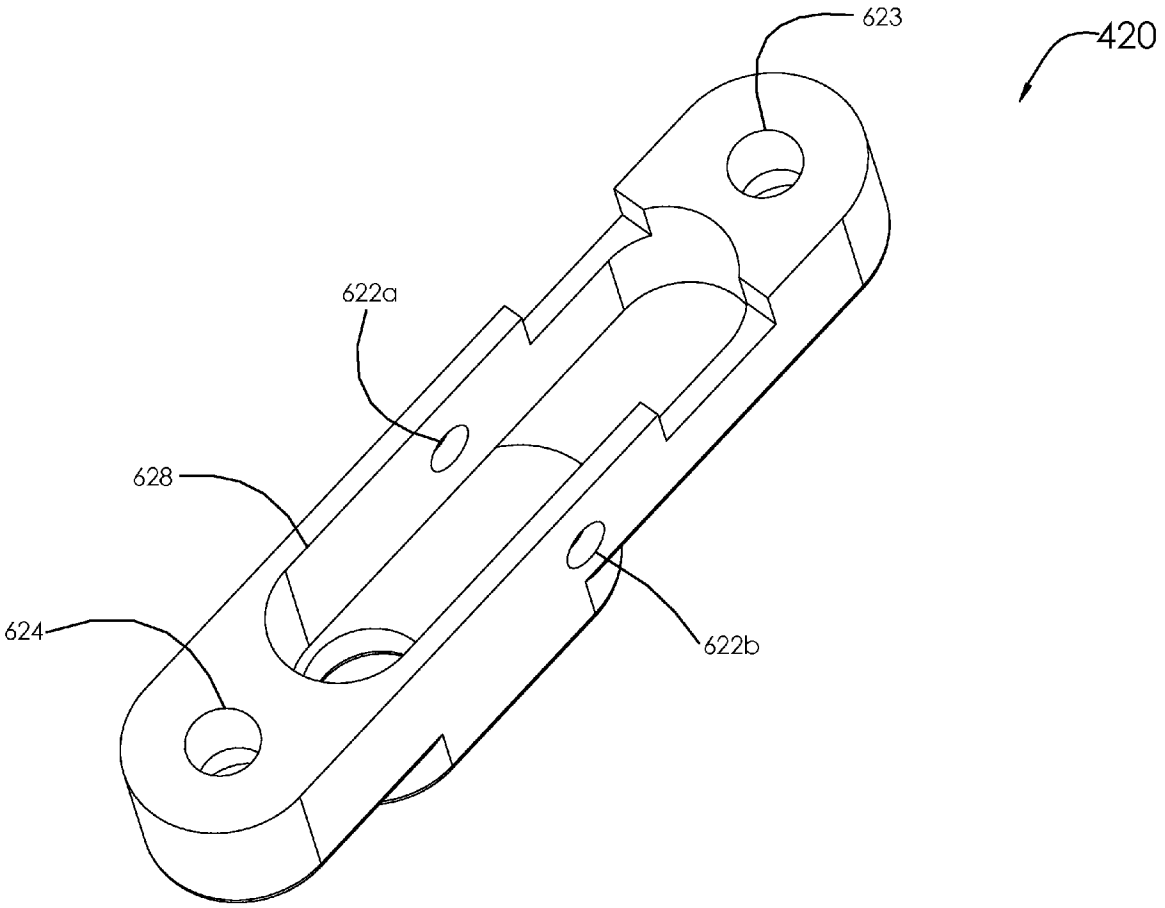
Figure 7:
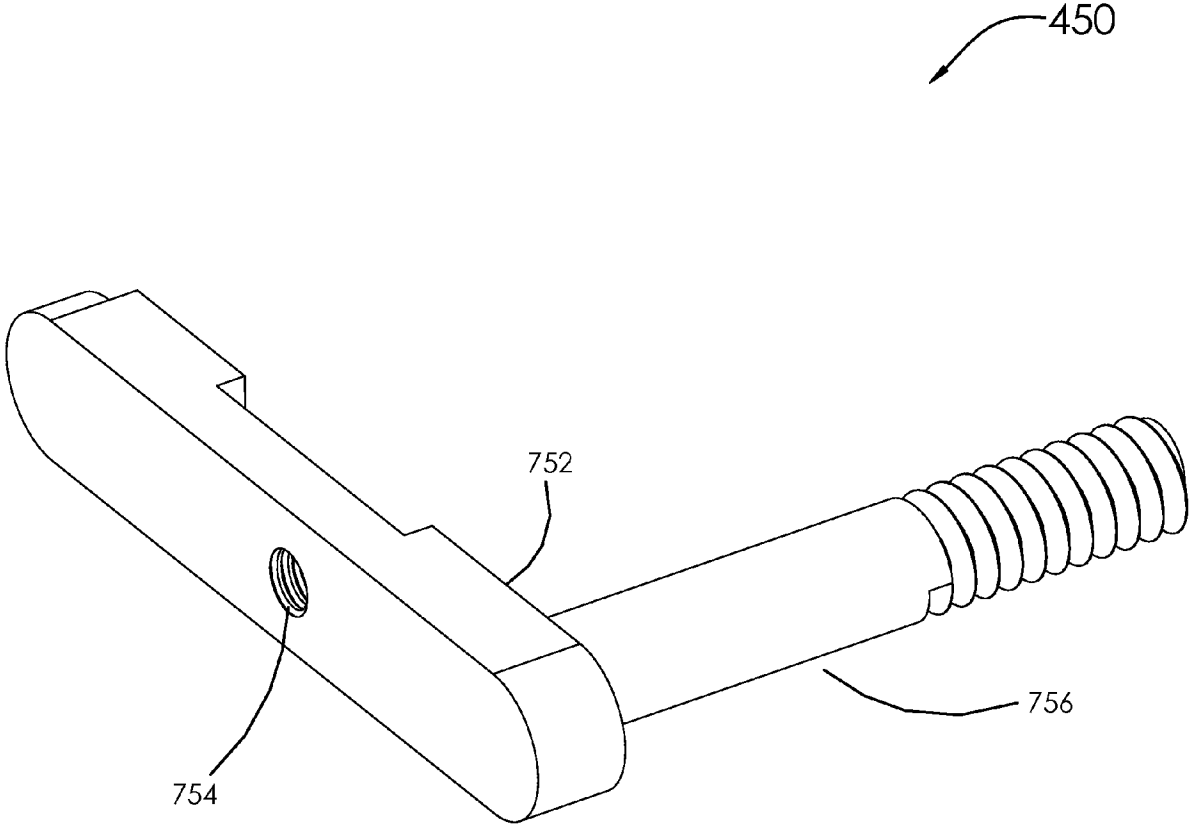
FIG. 7 is a perspective view of a mag-release catch of the left-sided magazine-release assembly of FIG. 3.
Figure 8B:
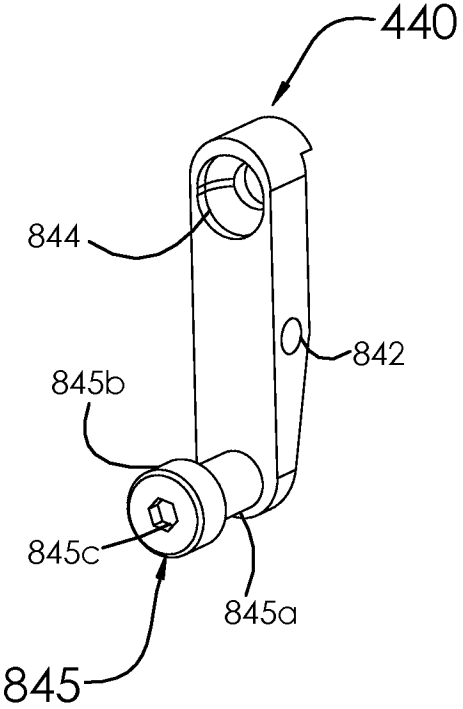
FIGS. 8A and 8B are exploded and assembled perspective views of a mag-release actuator of the left-sided magazine-release assembly of FIG. 3.
Figure 8A:
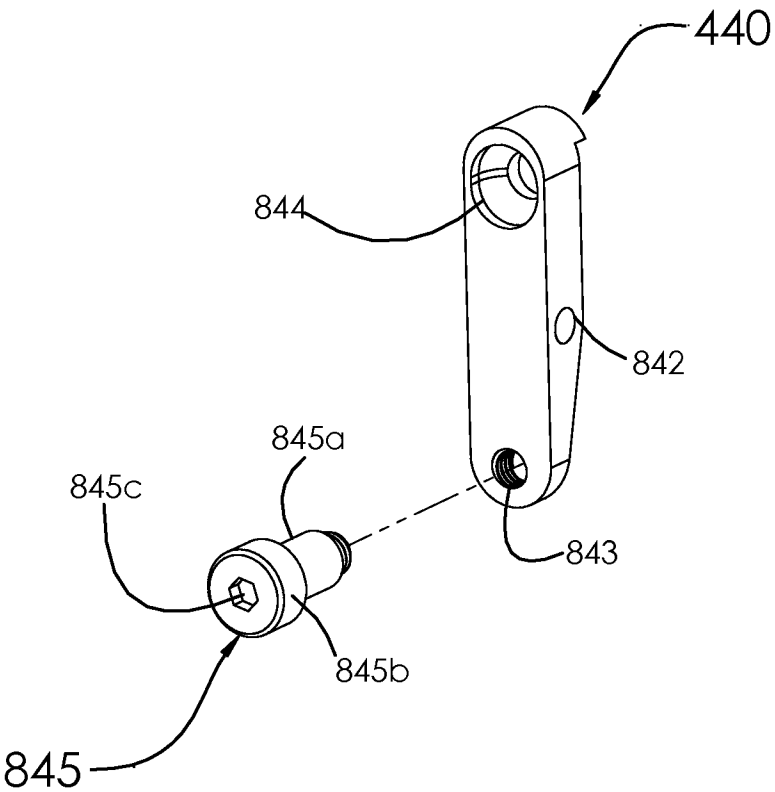
Figure 9:
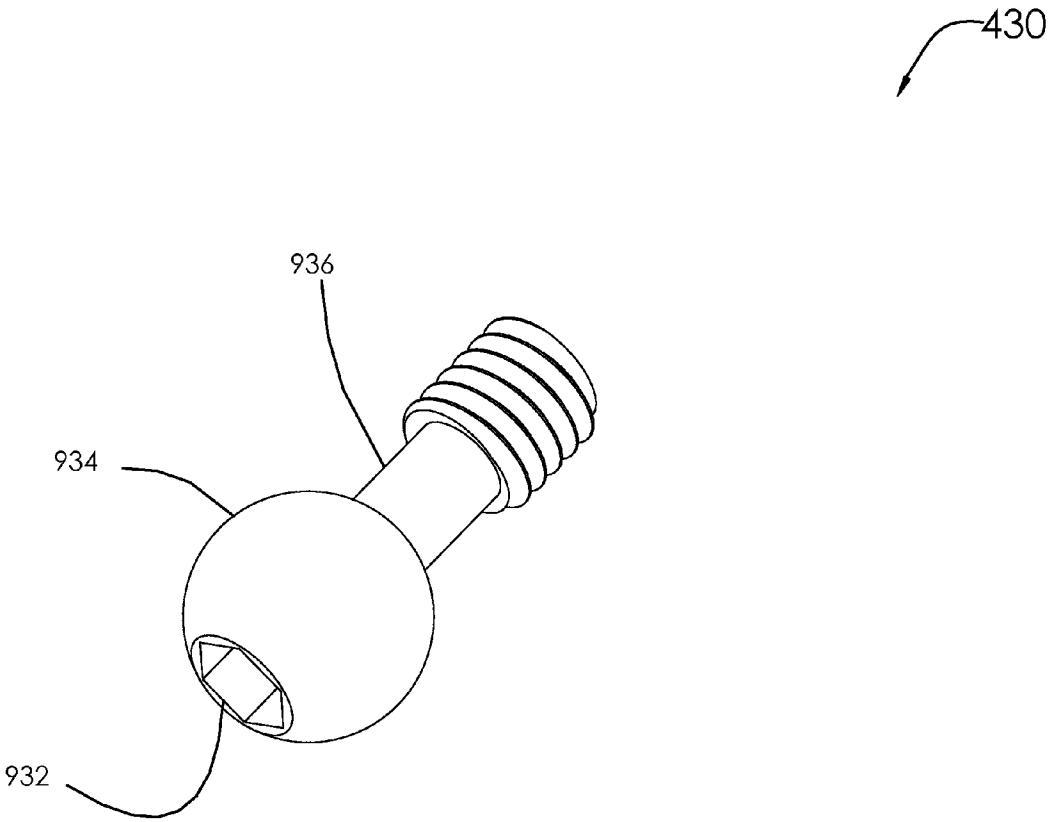
FIG. 9 is a perspective view of a mag-release coupler of the left-sided magazine release assembly of FIG. 3.

Referring also to the detailed views of FIGS. 6A-9, mag-release actuator cover 420 includes mounting holes 623, 624, an actuator port 626, pivot supports 622*a*, 622*b* and an actuator recess 628 as shown in the top and bottom perspective views of FIGS. 6A-6B. FIG. 7 is a perspective view of mag-release catch 450 which includes a magazine catch 752, a threaded shaft 756 and a threaded hole 754. FIGS. 8A-8B are exploded and assembled perspective views of mag-release actuator 440 which includes a pivot hole 842, a bowl-shaped coupler socket 844 and a threaded hole 843 for accepting an optional actuator guide 845. FIG. 9 is a perspective view of mag-release coupler 430 which includes a spherical head 934 with a hex-socket recess 932 and a threaded rod 936.

In this embodiment, the right-sided mag-release components of lower receiver 300 may be assembled prior to completing the assembly of the left-sided mag-release components. Accordingly, mag-release catch 450 is inserted into left-sided mag-release catch recess 415 located on the left side of exemplary stripped receiver 410. Bullet button shield 260 is aligned to the right-sided mag-release catch recess 516 and installed through the threaded shaft 756, followed by the mag-release spring 270 over the threaded shaft 756. Tool-actuated mag-release button 280 can now be screwed to the threaded end of shaft 756 of mag-release catch 450 and secured with a suitable method such as Loctite™, thereby completing the assembly of right-sided components for receiver 300.

Assembly of the left-sided tool-actuated mag-release components of receiver 300 discussed above may be accomplished as follows. First, mag-release actuator 440 is placed and properly aligned inside actuator recess 628 of mag-release actuator cover 420. Actuator 440 can now be secured to cover 420 by inserting pivot pin 425 into pivot support 622*a*, through pivot hole 842 and then into pivot support 622*b*, or vice versa.

Next, as also shown in FIG. 3, mag-release actuator cover 420 can be mounted to receiver 410 by fastening screws 421*a*, 421*b* through mounting holes 623, 624 and into the corresponding threaded holes 411*a*, 411*b* of receiver 410. Mag-release actuator 440 can be operatively coupled to mag-release catch 450 by seating spherical head 934 of coupler 430 inside socket 844 of mag-release coupler 430, and screwing a thread end of coupler rod 936 into the corresponding threaded hole 754 of mag-release catch 450. This is possible because socket 844 is partially exposed through a window 629 of actuator cover 420. Note that the screwed left-sided mag-release components of receiver 300 can be further secured with a suitable method such as Loctite™.

Assembly of both the left-sided and right-sided tool-actuated mag-release components of this embodiment is completed, and the mag-release catch 450 can now be ambidextrously actuated from either the left or right side of the receiver 410 with a suitable mag-release tool, e.g., the substantially pointed bullet tip of a rifle cartridge. Note that mag-release tool access to mag-release actuator 440 via actuator guide 845 is possible through restricted actuator port 626 of cover 420, thereby preventing the mag-release actuator 440 from being actuated without use of the suitable mag-release tool.

Modifications to the tool-actuated mag-release components of receiver 300 are possible. For example, while actuator 440 is a pivoting lever in the above described embodiment, actuator 440 can also be based on some other suitable mechanical design(s) that enables a suitable mag-release tool to mechanically actuate mag-release catch 450, including a wedge or a gear.

Other possible modifications to the tool-actuated mag-release assembly of FIG. 4 include changes to the actuator port 626 of actuator cover 420 to enable quicker alignment of a mag-release tool relative the port 6262 and/or to improve the ease of insertion of a mag-release tool into the port 626.

For example, the bevel of port 626 can be increased to create a larger funnel-shaped guide for the tip of the mag-release tool (not shown). Nylon inserts may also be added to the port 626 to increase lubricity. Ledges configured to guide mag-release tools may also be added to receiver 410. Visibility of the port 626 can be increased by incorporating light-colored or florescent paint, lithium inserts, or light-colored nylon inserts.

As discussed above and shown in FIG. 3, a rifle cartridge 395 with a pointed bullet tip can be used as a mag-release tool. Other suitable mag-release tools include specialized tools, magazines with mag-release tips, and rings with mag-release tips intended to be worn on the user's finger.

Figure 10:
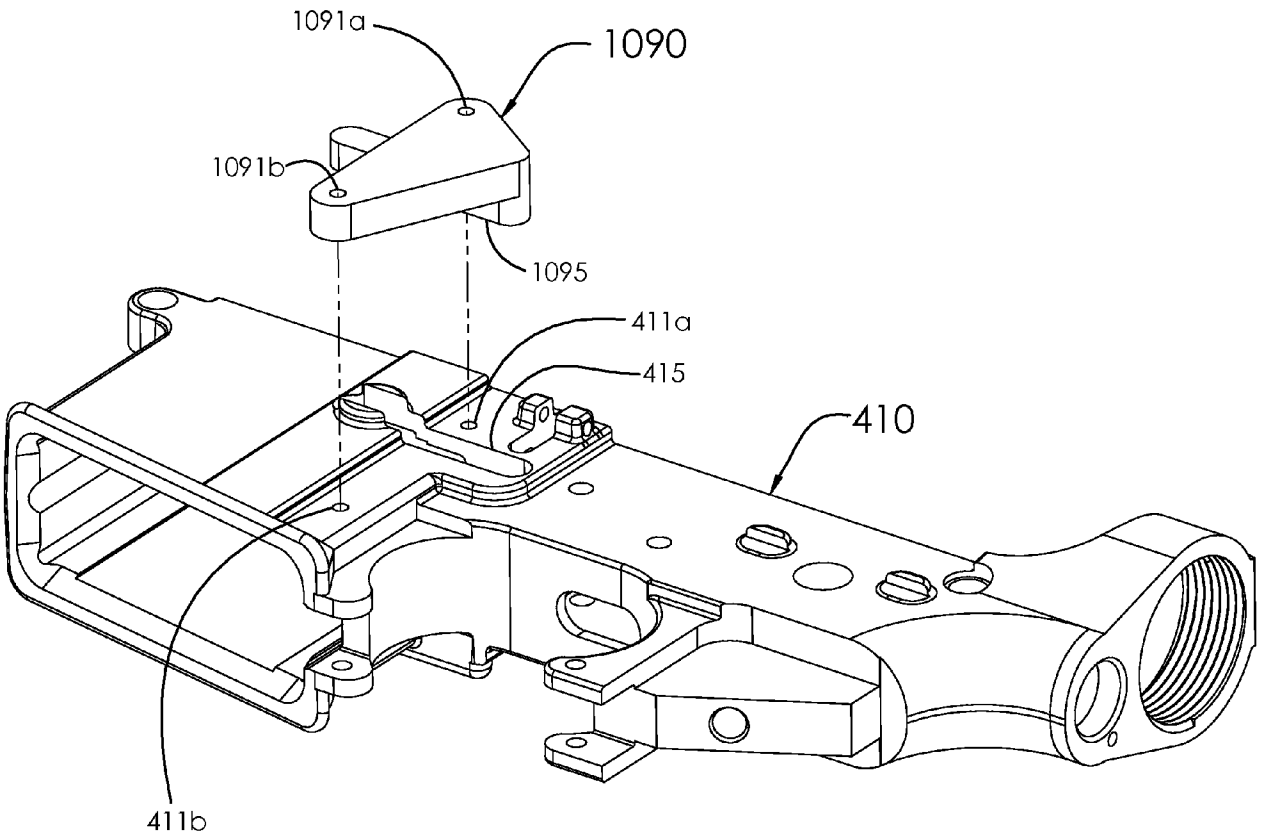
FIG. 10 illustrates a stripped lower receiver together with a jig for drilling installation holes for mounting the magazine-release assembly of FIG. 3.

Referring now to FIG. 10, one embodiment of an installation jig 1090 for efficiently and accurately drilling mounting holes 411*a*, 411*b* on stripped receiver 410 is shown. These two installation holes 411*a*, 411*b* are for mounting the left-sided tool-actuated mag-release assembly of FIG. 4. Jig 1090 includes a mag-release catch insert 1095 and a couple of guide holes 1091*a*, 1091*b*, and is configured for ease of use with hand-held tools, e.g., a portable hand drill. Hence, mag-release catch insert 1095 is configured to snugly fit into mag-release catch recess 415 located on the left side of receiver 410.

Accordingly, a user prepares receiver 410 for installation of the left-sided mag-release assembly by removing any existing mag-release catch. Mag-release catch insert 1095 of jig 1090 can now be inserted into left-sided catch recess 415 located in the left side of exemplary stripped receiver 410. The bottom surface of the main body of jig 1090 should be flush with the left top surface of receiver 410, and the guide holes 1091*a*, 1091*b* can now be to used to guide a suitable drill bit for drilling the two corresponding mounting holes 411*a*, 411*b* located on a left side of receiver 410 for mounting the left-sided tool-actuated mag-release assembly. After drilling, holes 411*a*, 411*b* can be tapped with the appropriate threads for accepting mounting screws 421*a*, 421*b*.

Suitable materials for fabricating jig 1090 include hardened steel or ceramic. Alternatively, a softer material such as aluminum or polymer can be used in combination with steel inserts for lining the guide holes 411*a*, 411*b*.

Figure 11B:
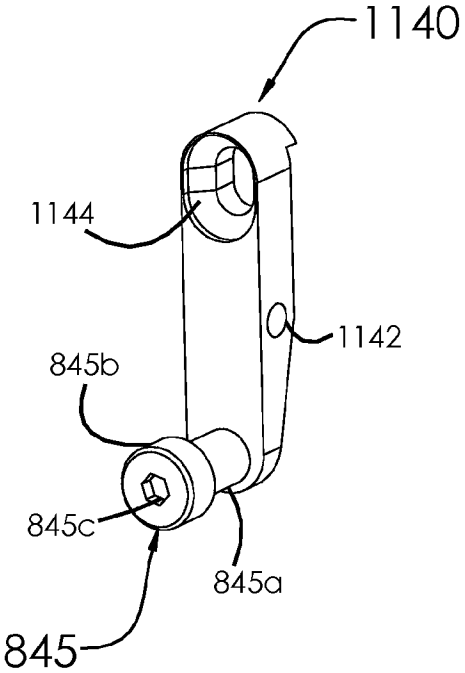
FIGS. 11A-11B and FIG. 12 are perspective views of alternate embodiments of an actuator and an actuator coupler, respectively, for the left-sided tool-actuated magazine release assembly of FIG. 3.
Figure 11A:
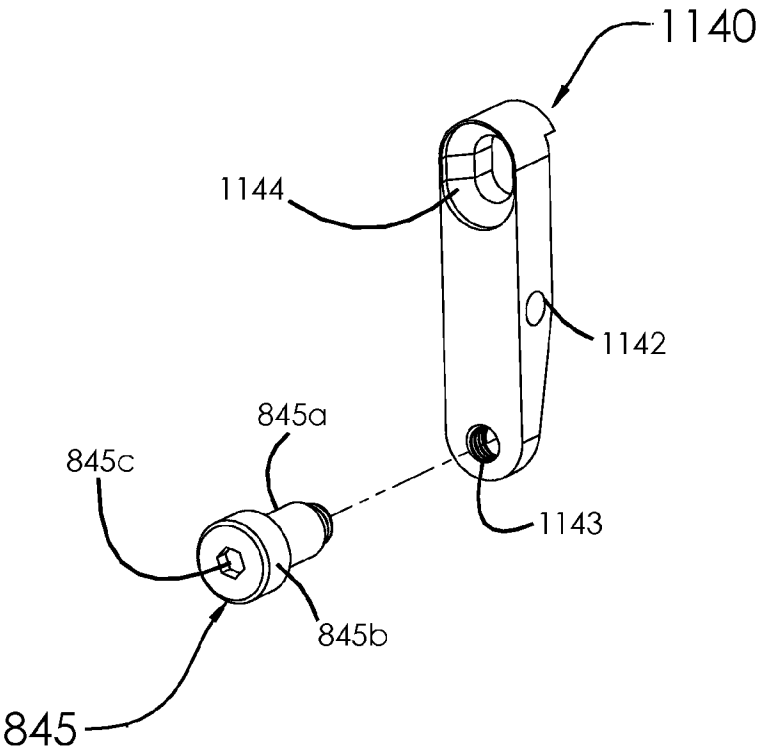
Figure 12:
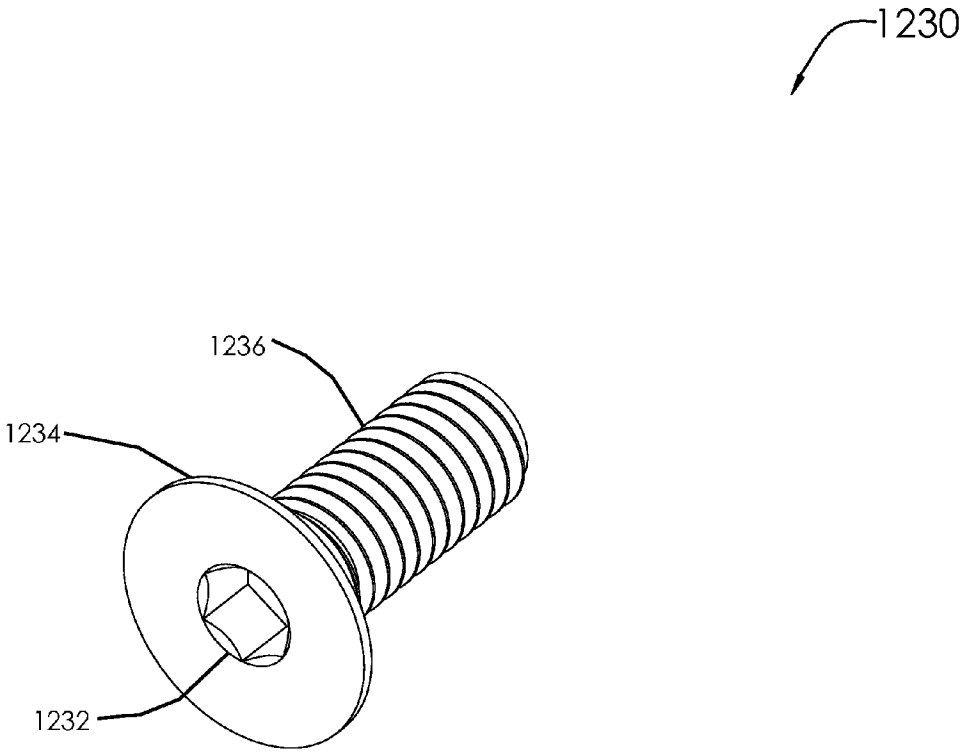

FIGS. 11A-11B and FIG. 12 illustrate alternate embodiments of an actuator 1140 and an actuator coupler 1230, suitable for substituting actuator 440 and coupler 430 of the left-sided tool-actuated magazine release assembly for receiver 300. In this embodiment, coupler 1230 can be a machine screw with a countersunk head 1234 and a threaded coupler shaft 1236. Coupler head 1234 is configured to be seated in elongated bowl 1144 of actuator 1140, while coupler shaft 1236 is configured to be screwed into and secured to threaded hole 754 of mag-release catch 450.

Installation and operation of this embodiment with actuator 1140 and coupler 1230 are as described above for actuator 440 and coupler 430. For example, actuator 1140 can be secured to actuator cover 420 by inserting pivot pin 425 into pivot support 622*a*, through pivot hole 1142 and then into pivot support 622*b*, or vice versa.

Materials are suitable fabricating mag-release components of receiver 300 include suitable metal alloys such as aluminum, titanium, and/or steel, and/or suitable polymers such as polycarbonate, nylon-impregnated plastics and/or and Delrin™. To enhance durability and/or lubricity, the mag-release components of receiver 300 described above can also be painted, powder-coated, electroplated and/or rubberized. In addition to or in place of mechanical fastening techniques such as using screws and threaded holes described above, other installation techniques are also possible, including welding, adhesives, chemical bonding, heat bonding and combinations thereof.

It should be appreciated that the AR-15 family of firearms have proliferated since the 1960s and many variants are now are manufactured by several prominent firearms companies including Colt, Smith & Wesson and Bushmaster. The original AR-15 platform has also evolved to include many modifications to the original gas-operated rifle with a fixed carrying handle, and these modifications include piston-operated bolt carriers, quick-change barrels and flat-top upper receivers. AR-15 variants are also available in a wide range of pistol calibers such as 9 mm Parabellum, 40 S&W and 45 ACP, and rifle calibers such as 5.56×45, 6.8×43, 7.62×39 and 7.62×51.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A magazine release assembly useful in association with an AR-15 variant firearm configured to operate with a detachable magazine, the magazine release assembly comprising:

a mag-release catch configured to be operatively coupled to a firearm and further configured to be operatively coupled to a detachable magazine inserted into a magazine well of the firearm;

a tool-actuated mag-release actuator configured to be operatively coupled to the mag-release catch and further configured to be actuated by a mag-release tool thereby causing the magazine to be detachable from the magazine well of the firearm;

a mag-release actuator cover configured to be mounted on a left side of the firearm, and further configured to support and to substantially shield the mag-release actuator thereby permitting the mag-release actuator to be actuated with any mag-release tool from the left side the firearm while preventing the mag-release actuator from being actuated without use of any mag-release tool; and a pivot pin, wherein the mag-release actuator is a lever configured to rotate about an axis of the pivot pin, and wherein the lever is configured to be assembled substantially inside the actuator cover using the pivot pin.

2. The magazine release assembly of claim 1 wherein the mag-release actuator is configured to be operatively coupled to the mag-release catch via a mag-release coupler.

3. The magazine release assembly of claim 1 further comprising:

a mag-release spring configured to be operatively coupled to the mag-release catch;

a tool-actuated mag-release button configured to be operatively coupled to the mag-release catch, and wherein the mag-release button is configured to be actuated by any mag-release tool from the right side of the firearm and causing the magazine to be detachable from the firearm; and a mag-release button shield configured to be mounted on a right side of the firearm, and further configured to substantially shield the mag-release button thereby preventing the mag-release button from being actuated without use of any mag-release tool.

4. The magazine release assembly of claim 3 wherein the mag-release actuator is configured to be operatively coupled to the mag-release catch via a mag-release coupler.

5. A firearm configured to operate with a detachable magazine and a magazine release tool, the firearm comprising:

a lower receiver having a magazine well configured to house a detachable magazine, and wherein the lower receiver is further configured to accept a magazine release assembly including:

a mag-release catch configured to be operatively coupled to the lower receiver and further configured to be operatively coupled to the detachable magazine inserted into the magazine well;

a tool-actuated mag-release actuator configured to be operatively coupled to the mag-release catch and further configured to be actuated by a mag-release tool thereby causing the magazine to be detachable from the magazine well;

a mag-release actuator cover configured to be mounted on a left side of the lower receiver, and further configured to support and to substantially shield the mag-release actuator thereby permitting the mag-release actuator to be actuated with any mag-release tool from the left side the lower receiver while preventing the mag-release actuator from being actuated without use of any mag-release tool;

a mag-release spring configured to be operatively coupled to the mag-release catch;

a tool-actuated mag-release button configured to be operatively coupled to the mag-release catch, and wherein the mag-release button is configured to be actuated by any mag-release tool from a right side of the lower receiver and causing the magazine to be detachable from the firearm; and a mag-release button shield configured to be installed on the right side of the lower receiver, and further configured to substantially shield the mag-release button thereby preventing the mag-release button from being actuated without use of any mag-release tool.

6. The firearm of claim 5 further comprising a pivot pin, wherein the mag-release actuator is a lever configured to rotate about an axis of the pivot pin, and wherein the lever is configured to be assembled substantially inside the actuator cover using the pivot pin.

7. The firearm of claim 5 wherein the mag-release actuator is configured to be operatively coupled to the mag-release catch via a mag-release coupler.

8. The firearm of claim 5 further comprising an upper receiver having a barrel assembly and a bolt carrier group.

9. The firearm of claim 8 further comprising a rifle stock and a trigger group operatively coupled to the lower receiver.

* * * * *